US010028889B2

(12) United States Patent
Despa et al.

(10) Patent No.: US 10,028,889 B2
(45) Date of Patent: Jul. 24, 2018

(54) SYSTEM FOR SORTING AND DISPENSING ORAL MEDICATIONS

(71) Applicant: Becton, Dickinson and Company, Franklin Lakes, NJ (US)

(72) Inventors: Mircea Stefan Despa, Cary, NC (US); Theresa Forshey, Durham, NC (US); Glenn Vonk, Fuquay-Varina, NC (US); Dylan Wilson, Pittsboro, NC (US); Adam Martin, Holly Springs, NC (US); Sundeep Kankanala, Chapel Hill, NC (US)

(73) Assignee: BECTON, DICKINSON AND COMPANY, Franklin Lakes, NJ (US)

( * ) Notice: Subject to any disclaimer, the term of this patent is extended or adjusted under 35 U.S.C. 154(b) by 0 days.

(21) Appl. No.: 14/852,215

(22) Filed: Sep. 11, 2015

(65) Prior Publication Data

US 2016/0075460 A1 Mar. 17, 2016

Related U.S. Application Data

(60) Provisional application No. 62/050,064, filed on Sep. 12, 2014.

(51) Int. Cl.
*B65B 57/20* (2006.01)
*A61J 7/00* (2006.01)
(Continued)

(52) U.S. Cl.
CPC ..... *A61J 7/0084* (2013.01); *A61J 7/0454* (2015.05); *G07F 17/0092* (2013.01);
(Continued)

(58) Field of Classification Search
CPC .... A61J 7/0084; A61J 7/0454; A61J 2205/10; A61J 2205/60; A61J 2200/30; G07F 17/0092; B65B 57/20
(Continued)

(56) References Cited

U.S. PATENT DOCUMENTS 5,522,525 A 6/1996 McLaughlin et al.
7,359,765 B2 * 4/2008 Varvarelis ..... A61J 7/0481 221/265
(Continued)

FOREIGN PATENT DOCUMENTS

EP 1 477 403 A1 11/2004
EP 1 704 844 A1 12/2004
WO WO 2008/112731 A2 9/2008

OTHER PUBLICATIONS

International Search Report and Written Opinion from International patent application No. PCT/US2015/049770 dated Dec. 4, 2015.
(Continued)

*Primary Examiner* — Michael Collins
(74) *Attorney, Agent, or Firm* — Knobbe, Martens, Olson & Bear, LLP

(57) ABSTRACT

A system for assisting patients in sorting and dispensing medication supplies comprises a storage tray having a number of storage compartments, and a communication system to identify a medication to be provided from a pill bottle and, based upon the identification and a known regime, automatically identify which compartments of the storage tray are to be filled with the identified medication from the pill bottle and perform the filling of the storage tray. In doing so, a patient can simply open and present any number of pill bottles to the system, and then allow the system to arrange the medication in the storage tray according to the known regimen. The regimen and regimen updates are communicated to the system by means of a wired or wireless transmission to the system from a remote location (e.g. pharmacy or doctor's office), by direct user input, or by reading such information from a barcode or similar information carrier affixed to the pill bottles.

25 Claims, 15 Drawing Sheets

(51) Int. Cl.
*A61J 7/04* (2006.01)
*G07F 17/00* (2006.01)

(52) U.S. Cl.
CPC ..... *A61J 2200/30* (2013.01); *A61J 2205/10* (2013.01); *A61J 2205/60* (2013.01); *B65B 57/20* (2013.01)

(58) Field of Classification Search
USPC ..... 700/236, 240
See application file for complete search history.

(56) References Cited

U.S. PATENT DOCUMENTS

2003/0099158 A1 5/2003 De La Huerga
2004/0148054 A1* 7/2004 Schwartz ..... A61J 1/035 700/231
2005/0023286 A1* 2/2005 Pinney ..... G06F 19/3462 221/123
2005/0218152 A1* 10/2005 Simon ..... A61J 7/0084 221/203
2008/0283542 A1* 11/2008 Lanka ..... G06F 19/3462 221/6
2013/0073078 A1 3/2013 Handfield et al.
2013/0149377 A1* 6/2013 Alfano ..... A61J 3/074 424/451
2013/0284755 A1* 10/2013 Yuyama ..... A61J 7/02 221/13
2013/0304255 A1 11/2013 Ratnakar
2014/0358278 A1* 12/2014 Zhang ..... G07F 17/0092 700/240
2015/0353213 A1* 12/2015 Kohl ..... B65B 69/0058 53/128.1

OTHER PUBLICATIONS

Supplementary Extended Search Report dated May 22, 2018 for European Patent Application No. 15840542.3, filed Mar. 16, 2017.

* cited by examiner

SYSTEM FOR SORTING AND DISPENSING ORAL MEDICATIONS

CROSS-REFERENCE TO RELATED APPLICATIONS

This application claims priority to U.S. Provisional Patent Application Ser. No. 62/050,064 filed on Sep. 12, 2014 and entitled "System for Sorting and Dispensing Oral Medications", the content of which is hereby incorporated by reference in its entirety.

FIELD OF THE INVENTION

The present invention relates to a system for assisting patients in sorting and dispensing medication supplies. The system includes a storage tray having a number of storage compartments, and a communication system to identify a medication to be provided from a pill bottle and, based upon the identification and a known regime, automatically identify which compartments of the storage tray are to be filled with the identified medication from the pill bottle and perform the filling of the storage tray. In doing so, a patient can simply open and present any number of pill bottles to the system, and then allow the system to arrange the medication in the storage tray according to the known regimen. The regimen and regimen updates are communicated to the system by means of a wired or wireless transmission to the system from a remote location (e.g. pharmacy or doctor's office), by direct user input, or by reading such information from a barcode or similar information carrier affixed to the pill bottles.

BACKGROUND OF THE INVENTION

Many patients with chronic conditions have difficulty adhering to prescribed therapies. In general, the more medications taken and the more times each day that patients must use various therapies, the more likely there will be a medication error. Often patients have co-morbid conditions that interfere with their adherence to medication regimens. These conditions may include diabetes and associated complications such as blindness or lack of mobility, various neurological conditions and dementias, arthritis and associated difficulties in manipulating devices, and other debilitating conditions. The interactions of various co-morbidities can bring additional complexity and dynamism to medication regimens. Cognition also generally declines with age. Consequently, elderly patients may experience difficulty filling and organizing their medications, and remembering to take them as prescribed. These problems are widely recognized, but there have been no cost-effective solutions to date.

Most medication taken at home is in oral form: solid pills, tablets, and gel capsules. Treatments for the chronically ill are typically composed of several, if not many, different medications. For example, congestive heart failure (CHF), a common condition in adults over the age of 50, often requires patients to take 8 or more prescription medications. Such multiple medications come in different dosages, and are prescribed to be taken at different intervals during the day. This combination of large number of pills and remembering various administration times makes a complex medication regimen—polypharmacy—difficult for patients to manage and follow. It should also be remembered that these patients may even have a hard time with a simple regimen due to their advanced age or due to an implicit cause of their condition. Difficulties can occur both when pre-arranging the daily regimen and at the time of taking the dosage. The wrong pills can be prepared to be taken at the wrong time, in the wrong dosage, or pills may not be taken at all. Even with careful planning, come administration time, the medication can still be forgotten and missed. Worse, polypharmacy treatments can be composed of medications that can interact and lead to complications for instance, when episodic medications are added to treat acute conditions.

In the past decade, the increase of polypharmacy regimens has led to a correlating increase in non-adherence and thus, a resulting increase in complications, disease severity, and even death. The societal costs associated with medication non-adherence have been estimated to be in the hundreds of billions of dollars.

Consequently, solutions have been proposed to alleviate the problem. These solutions include devices that assist the patient with arranging the medication in predetermined groups to be taken together and reminders to take the medication at the correct time. In the U.S., to simplify the situation and based on clinical evidence, a standardization of the times during the day when medications are to be taken has even been developed and implemented.

Examples of devices that assist the patient with prearranging the oral medications include pill boxes and pill sorters such as the MedMinder Pill Dispenser, the Philips Lifeline, and the Compumed Medication Dispenser. Small pill caps are also now available which can be mounted on top of regular pill bottles to alert the patient that it is time to take the medication. Some of these devices also log the event of the patient taking the medication (or missing it, as it might be). This is accomplished via capturing a proxy event, in most cases the opening and closing of the pill compartment or pill bottle. Smartphone apps have also been developed to help remind the patient that it is time to take the medication, and to communicate with the patient's caregivers, family, friends, clinician that the medication has or has not been taken at the right time.

While such devices and apps have been developed with the same aim, to help reduce the non-adherence problem, they fail to provide a comprehensive solution to helping the patient on a polypharmacy treatment adhere to the complex regimen. Some of the existing solutions provide assistance with manual filling, but do not allow for automated sorting of the pills if the patient is dependent on others to organize their medications. One such example is the MedMinder device. Some other solutions provide pill counting functionality, but do not operate with multiple pills at the same time. One such example is the Kirby unit. Still other solutions include simple timers with alarms, such as the Reminder Rosie. Other devices, such as the GlowCap remind the user to take the medicine contained in a single pill bottle, but cannot provide sorting assistance or serve a polypharmacy regimen with a single device.

Accordingly, a need exists to develop a comprehensive, end-to-end solution that provides the patient with assistance in sorting the complex regimen into multiple daily doses, reminds the patient when it is time to take the medication, easily dispenses the specific dose, and provides clear instructions related to the treatment.

SUMMARY OF THE INVENTION

It is therefore an object of embodiments of the present invention to provide a system and method to assist a patient in sorting a complex regimen into multiple daily doses, reminds the patient when it is time to take the medication, easily dispenses the specific dose, and provides clear instructions related to the treatment.

It is another object of embodiments of the present invention to provide a system and method which is integrated into the patient's ecosystem by both a design that incorporates into and adapts to the user's daily living and by connecting to the user's circle of care composed of people (caregivers, family, friends) and other medical devices.

These and other objects are substantially achieved by providing, in accordance with embodiments of the present invention, a system and method that can arrange and/or disburse medications in a complex polypharmacy regimen according to the individual doses of a multiple medication per day schedule, for several days. In an exemplary embodiment, the system arranges and/or disburses multiple pills in the specific combinations to be taken at specific times according the patient's prescriptions. The system checks the prescriptions to identify potential conflicts that could result in adverse interactions, and adapts to the user's specific preferences, for example, by using adaptive software that customizes a graphical user interface, the notifications type, and the connectivity to other devices. The system is configured to alert the user of the upcoming time to take medications, disburses the specific dose associated with that time, and records the event In at least one exemplary embodiment, the system and method monitors the patients' adherence to the treatment regimen by transmitting data associated with the event of the pills being disbursed to the user, to be used for monitoring adherence to the treatment regimen, and caregivers, family, and friends can be notified if the user misses a dose. In at least one exemplary embodiment, the system and method is configured to interface with multiple peripherals and devices in the user's ecosystem such as barcode readers, RFID readers, printers, wired or wireless telephone lines, blood pressure monitors, smart scales, and other similar devices.

BRIEF DESCRIPTION OF THE DRAWINGS

The above and other objects and advantages will become apparent upon consideration of the following drawings and detailed description. The preferred embodiments of the present invention are illustrated in the appended drawings in which like reference numerals refer to like elements and in which:

FIG. 21 is a network illustration of the exemplary control and communication system of the sorting and dispensing system of FIG. 1 in accordance with an embodiment of the invention.

In the drawing figures, it will be understood that like numerals refer to like structures.

DETAILED DESCRIPTION OF THE PREFERRED EMBODIMENT

Figure 1:
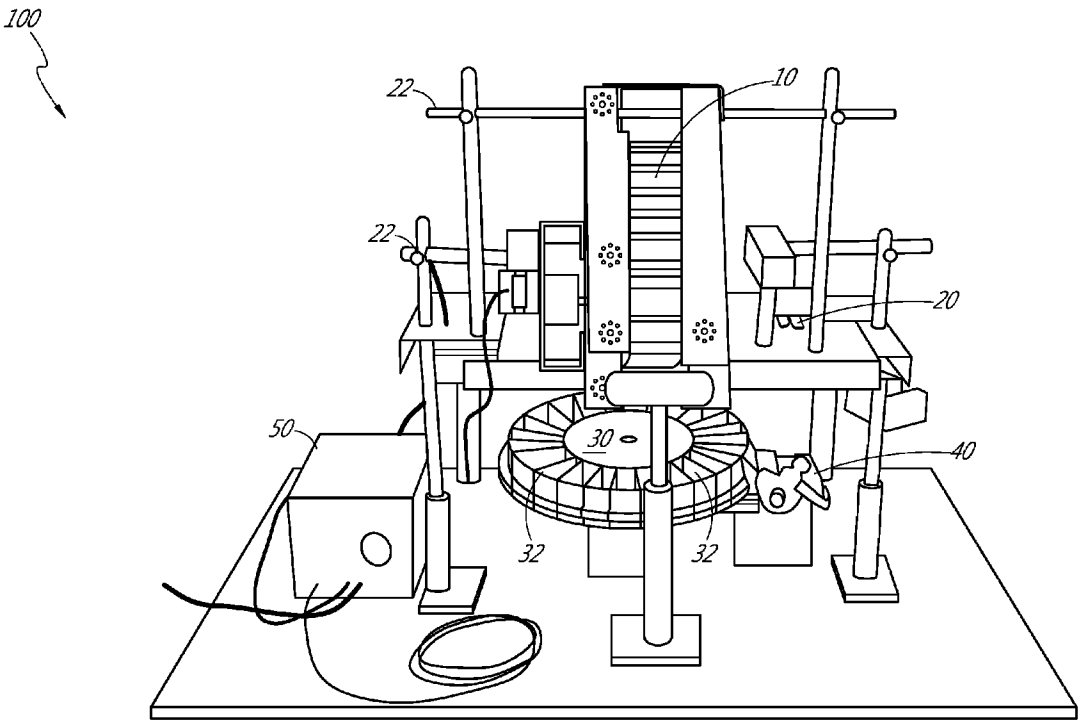
FIG. 1 is a front view of a system for sorting and dispensing oral or other medications in accordance with an embodiment of the invention.
Figure 2:
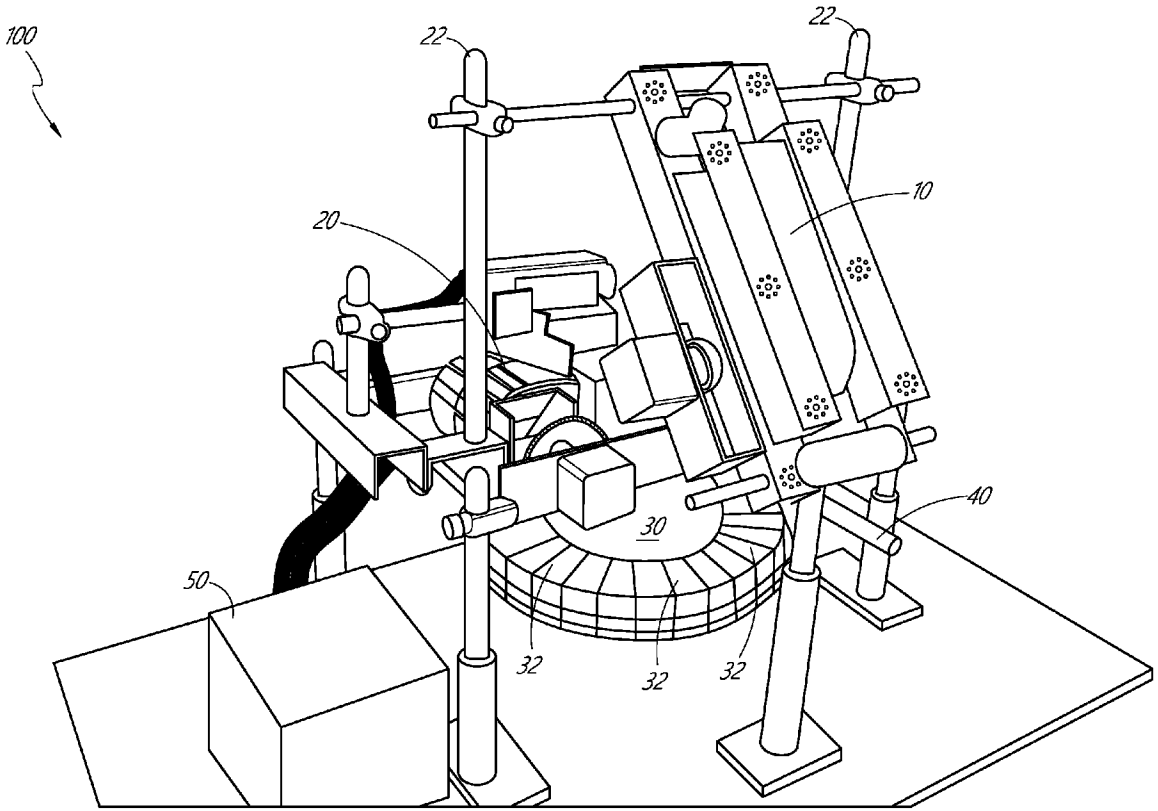
FIG. 2 is a front-left side perspective view of the sorting and dispensing system of FIG. 1 in accordance with an embodiment of the invention.
Figure 3:
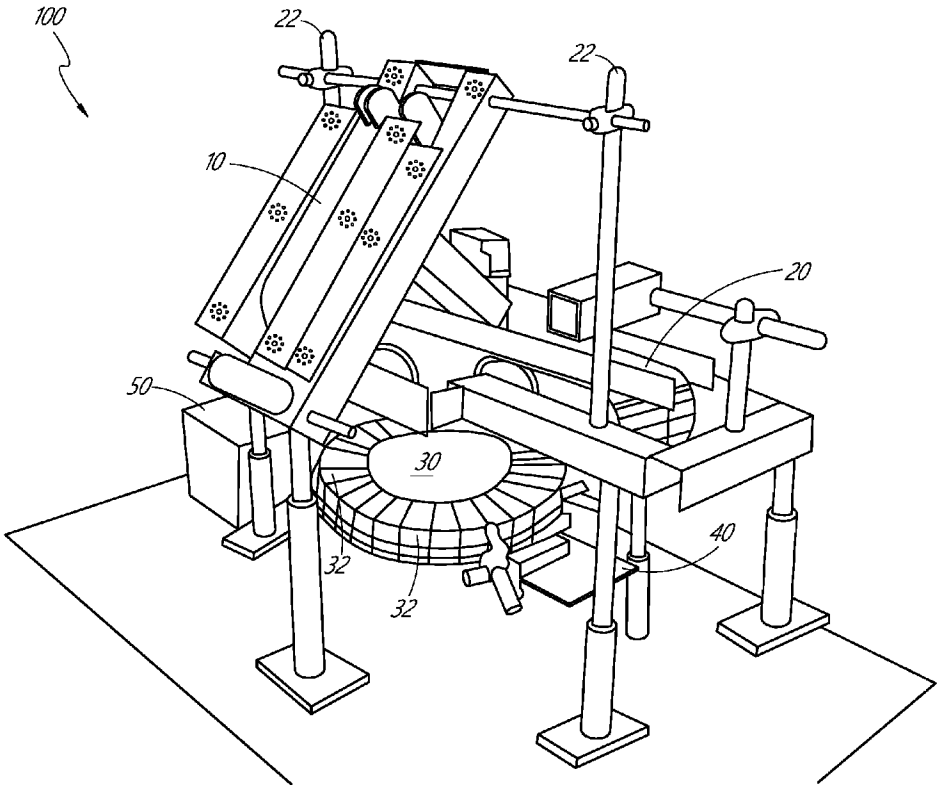
FIG. 3 is a front-right side perspective view of the sorting and dispensing system of FIG. 1 in accordance with an embodiment of the invention.
Figure 4:
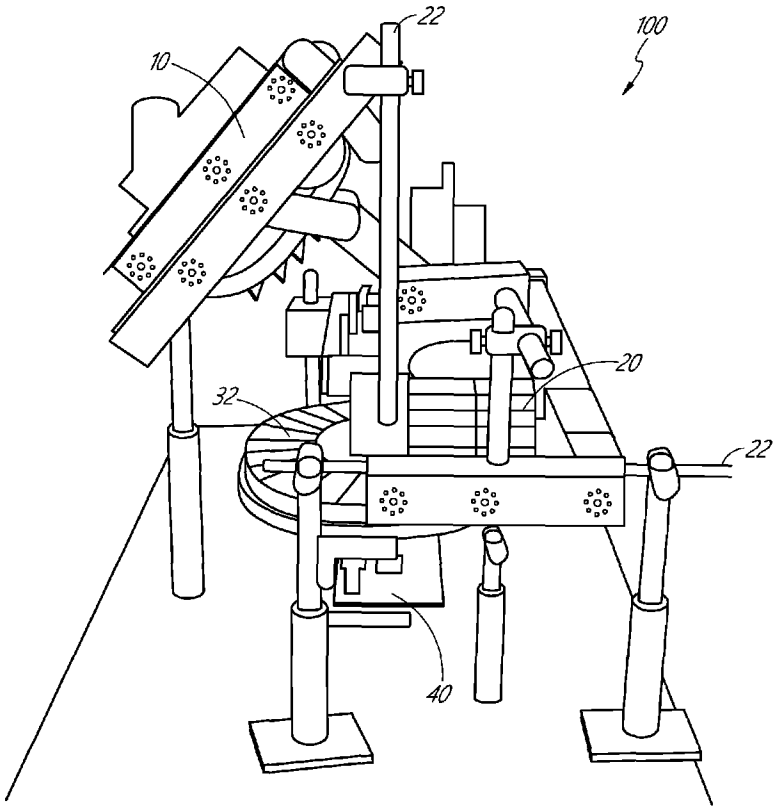
FIG. 4 is a right side view of the sorting and dispensing system of FIG. 1 in accordance with an embodiment of the invention.
Figure 5:
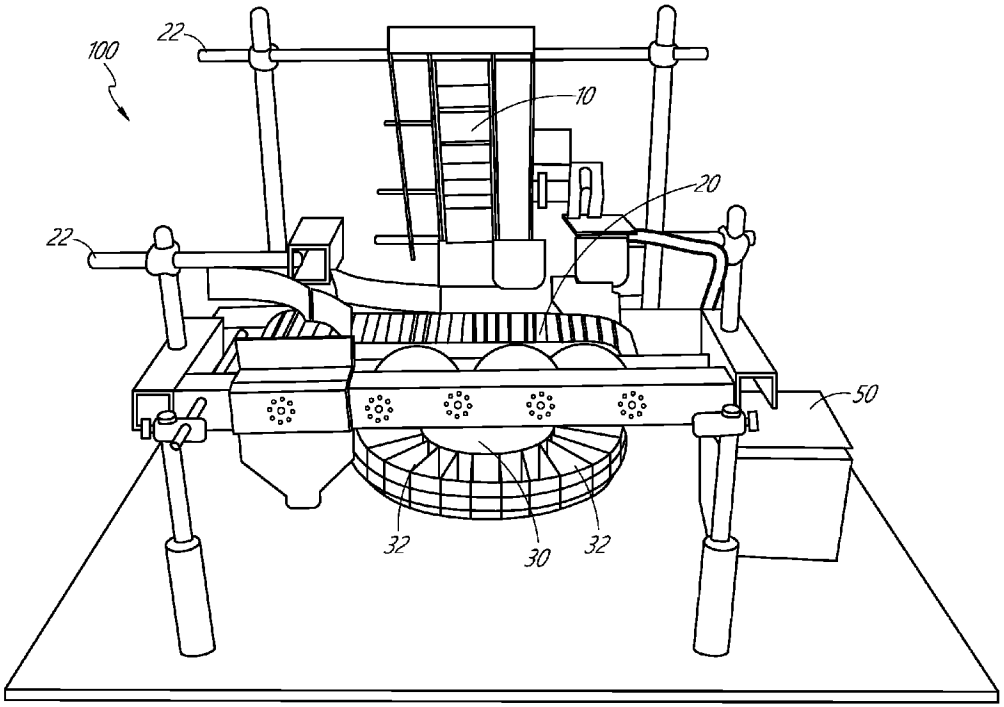
FIG. 5 is a rear view of the sorting and dispensing system of FIG. 1 in accordance with an embodiment of the invention.
Figure 6:
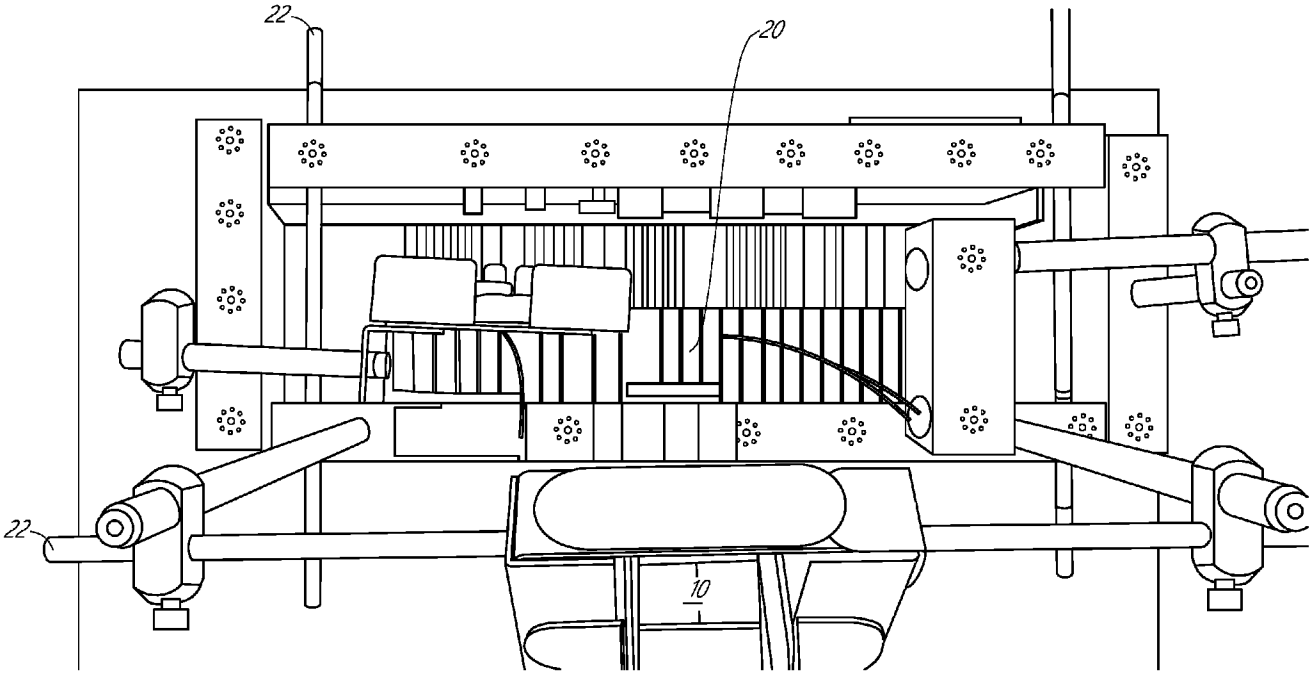
FIG. 6 is a top view of the sorting and dispensing system of FIG. 1 in accordance with an embodiment of the invention.

The various features of the preferred embodiments will now be described with reference to the drawing figures, in which like parts are identified with the same reference characters. The following description of the presently contemplated best mode of practicing the invention is not to be taken in a limiting sense, but is provided merely for the purpose of describing the general principles of the invention.

Embodiments of the present invention relate to a comprehensive, end-to-end system and method that provides the patient with assistance in sorting a complex medication regimen into multiple daily doses, reminds the patient when it is time to take the medication, easily dispenses the specific dose, and provides clear instructions related to the treatment. The system and method are integrated into the patient's ecosystem by both a design that incorporates into and adapts to the user's daily living and by connecting to the user's circle of care composed of people (caregivers, family, friends) and other medical devices.

Exemplary embodiments of the present invention are configured to arrange and/or disburse the medications in a complex polypharmacy regimen according to the individual doses of a multiple medication per day schedule, for several days. The system arranges and/or disburses multiple pills in the specific combinations to be taken at specific times according the patient's prescriptions. The system checks the prescriptions to identify potential conflicts that could result in adverse interactions, and the system adapts to the user's specific preferences, for example, by using adaptive software that customizes the graphical user interface, the notifications type, and the connectivity to other devices.

The system alerts the user of the upcoming time to take medications, disburses the specific dose associated with that time, and records the event For monitoring adherence to the treatment regimen, the system transmits the data associated with the event of the pills being disbursed to the user, to be used for monitoring adherence to the treatment regimen, and caregivers, family, and friends can be notified if the user misses a dose, The system interfaces with multiple peripherals and devices in the user's ecosystem such as barcode readers, RFID readers, printers, wired or wireless telephone lines, blood pressure monitors, smart scales, and other similar devices.

In a preferred embodiment, the system consists of several modules: a feeder module, a singulator module, a compartmentalized storing module, and a dispensing module. FIGS. 1 to 6 illustrate such a device for sorting and dispensing medications in accordance with an embodiment of the invention.

As shown in FIGS. 1 to 6, the exemplary system 100 includes a feeder module or conveyor 10, a singulator module 20, a compartmentalized storing module or tray 30, and a dispensing module 40. The feeder conveyor 20 can be moveable over a desired storage tray 30 by sliding the feeder conveyor along one or more rails 22. The feeder conveyor 20 is configured to receive and deliver a medication content at a specific rate and quantity to the desired location of the desired storage tray 30. The action to move and dispense the medication from the feeder conveyor 20 can be achieved using any number of suitable electromechanical actuators, motors and electromagnetic drives, optical sensors, such as light (LED, IR) emitters and detectors, pneumatic (above or below atmospheric) pumps and circuits, and temperature, pressure and proximity sensors. In an exemplary embodiment, the feeder conveyor 20 is a belt conveyor having a variable speed drive and control mechanism that is omitted from the present disclosure for clarity.

Figure 7:
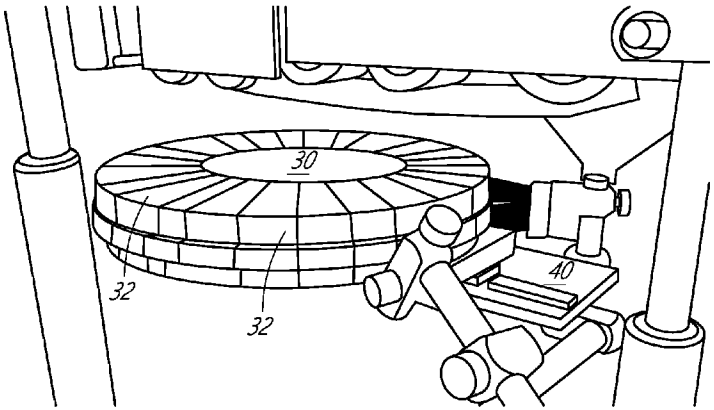
FIG. 7 is a perspective top view of the sorting or storage tray of the sorting and dispensing system of FIG. 1 in accordance with an embodiment of the invention.
Figure 8:
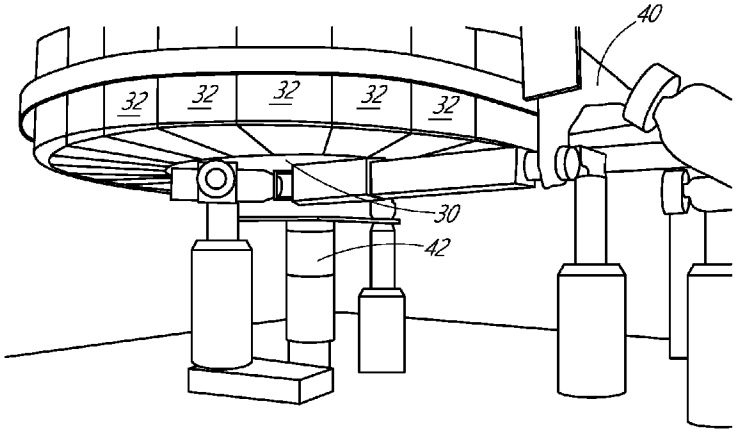
FIG. 8 is a perspective bottom view of the sorting or storage tray of the sorting and dispensing system of FIG. 1 in accordance with an embodiment of the invention.

As shown in more detail in FIGS. 7 and 8, the storage tray 30 can be placed beneath the feeder conveyor 20 to receive the medication content delivered by the feeder conveyor 20 at a specific rate and quantity. The storage tray 30 can be any suitable shape and include any suitable arrangement of chambers therein, but is not limited to the embodiment shown. In an exemplary embodiment, the storage tray 30 can be formed in a substantially circular shape and can be comprised of a plurality of chambers 32 positioned around a circumference of the storage tray 30. In these or other exemplary embodiments, the storage tray 30 can be constructed of any suitable materials that are compatible with the storage of medications such as molded plastic, but are not limited thereto.

Figure 10:
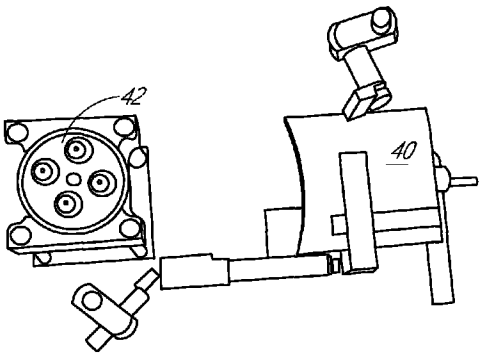
FIG. 10 is a perspective top view of the sorting or storage tray support and drive of the sorting and dispensing system of FIG. 1 in accordance with an embodiment of the invention.
Figure 9:
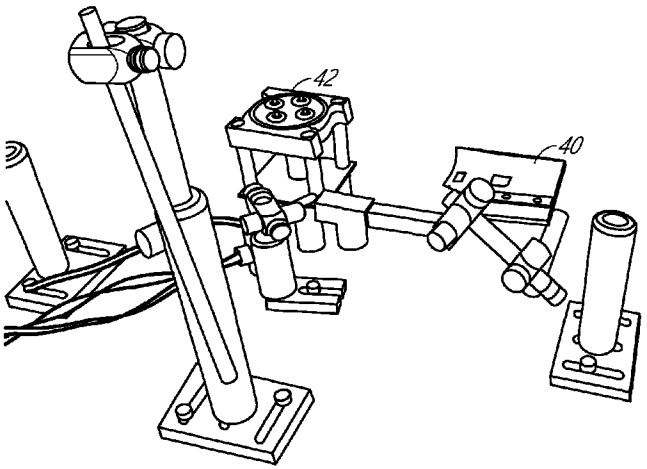
FIG. 9 is a perspective front view of the sorting or storage tray support and drive of the sorting and dispensing system of FIG. 1 in accordance with an embodiment of the invention.
Figure 12:
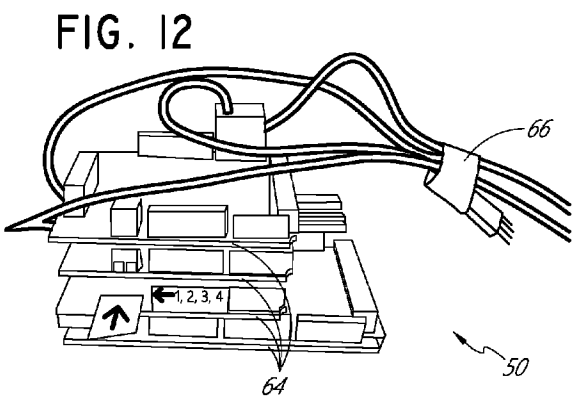
FIGS. 11 to 16 are perspective views of the control and communication system of the sorting and dispensing system of FIG. 1 in accordance with an embodiment of the invention.
Figure 14:
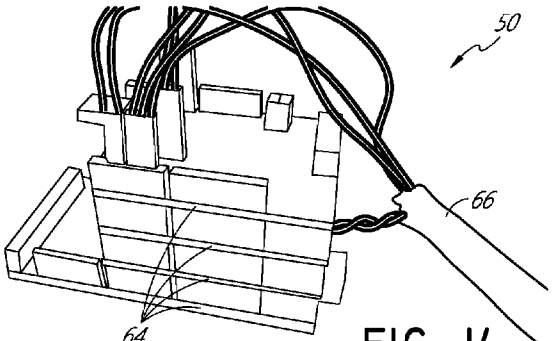
Figure 11:
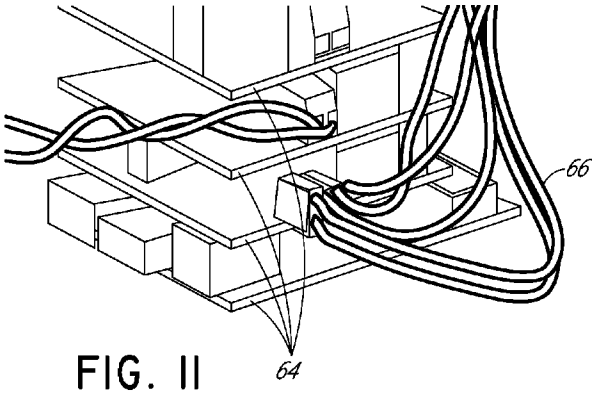
Figure 13:
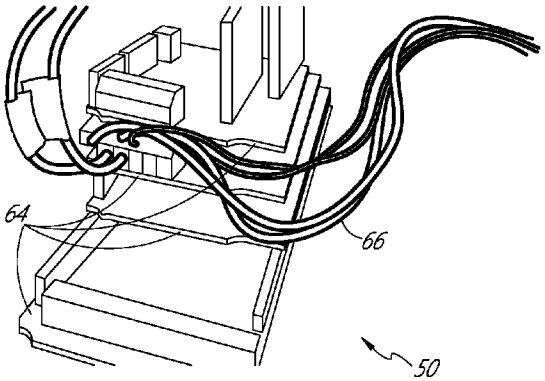
Figure 16:
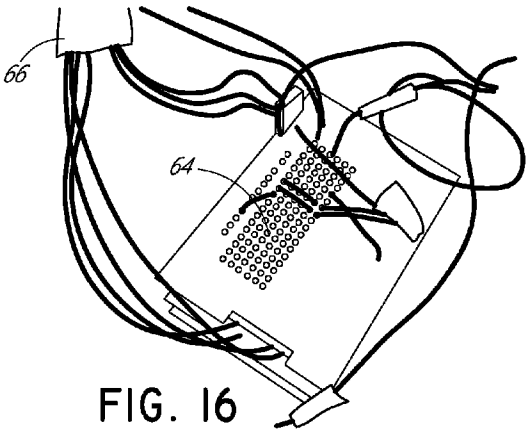
Figure 15:
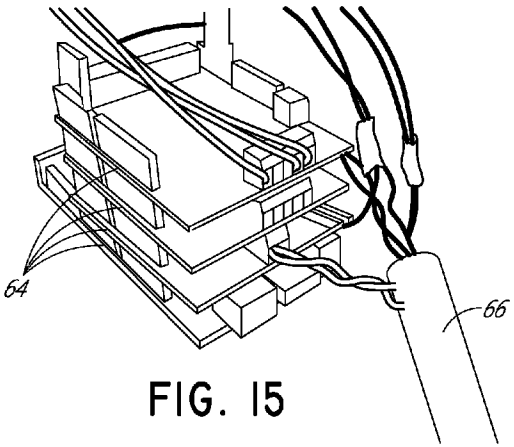
Figure 17:
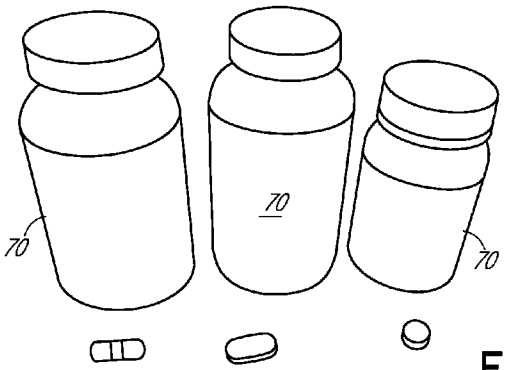
FIG. 17 are views of exemplary commercial packages or pill bottles and contents that can be used with the sorting and dispensing system of FIG. 1 in accordance with an embodiment of the invention.

As shown in more detail in FIGS. 9 and 10, the storage tray 30 is positioned upon a dispensing module 40 which rotates or otherwise moves the storage tray 30 to position a desired chamber 32 in a position to receive the medication content delivered by the feeder conveyor 20 at a specific rate and quantity, or to position a desired chamber 32 in a position to dispense the medication content of the desired chamber at a specific rate and quantity. The dispensing module 40 can be comprised of any suitable platform 42 to rotate or otherwise move the storage tray 30 into position using, any number of suitable electromechanical actuators, motors and electromagnetic drives, optical sensors, such as light (LED, IR) emitters and detectors, pneumatic (above or below atmospheric) pumps and circuits, and temperature, pressure and proximity sensors. In an exemplary embodiment, the storage tray 30 is moved into position using a variable speed drive and control mechanism that is omitted from the present disclosure for clarity.

The singulating module 20 is provided to isolate a single pill, from a group of multiple, unsorted pills. The singulating module 20 may work in conjunction with or separate from the feeder module or conveyor 10 and storage tray 30. For example, the singulating module 20 is configured to accept a multitude of pills from the feeder module or conveyor 10 and separates them into uniquely addressable single elements (pills) that are then placed (pushed, dropped, pulled, lifted) into a specific storage compartment 32 in the storage tray 30. In another example, the singulating module 20 can be designed and built such that it addresses bulk medication directly from a medication container (e.g. bottle) and serves a single pill directly to the user, on-demand. When working in conjunction with a feeder module or conveyor 10 and a tray module 30, once the singulating module 20 separates a given pill from a multitude of pills, the system 100 is configured to control the positioning of the storage tray 30 such that the medications of the feeder conveyor 10 are properly and automatically arranged in the chambers 32 of the storage tray 30 as directed by a medication regime.

Several possible architectures exist to allow the patient to simply open and present any number of pill bottles or containers to the system 100, and then allow the system 100 to arrange the medication in the chambers 32 of the storage tray 30 according to a known regimen. The regimen, including updated or revised regimens for each identified pill bottle deposited onto the feeder conveyor 10, is known to the system 100, for example, by means of wired or wireless transmission to the system 100 from a remote location (e.g., pharmacy or doctor's office), by direct user input, or by reading such information from a barcode or similar information carrier affixed to the pill bottles.

The wired or wireless communication of the system 100 is achieved by a communication and data processing system 50 of the system 100, such that the system 100 can communicate with an adjacent medication container using for example, barcode reading and/or radio-frequency identification (RFID) technology to obtain information about the medication in the adjacent medication container. For example, a user may receive a prescription or prescription refill from a doctor or pharmacy and wish to transfer the contents from the commercial package to the compartments 32 of the storage tray 30. One step in doing so is providing an automatic and electronic communication between the system 100 and the commercial package. The commercial package is often provided with a barcode, quick response code, identification number or RFID chip (including low-bit tags) to identify the contents, and content and prescription regimen information, which can be scanned and interpreted by the communication and data processing system 50 of the system 100. To do so, the communication and data processing system 50 of the system 100 comprises at least a scanning or communicating element to scan or otherwise interpret a barcode, quick response code, identification number or RFID chip of the commercial package when placed adjacent to the system 100, and process the information with or without additional information obtained by still other communications with other local devices such as printers, wired or wireless telephone lines, blood pressure monitors, smart scales, smart phones, tablets, pagers, cell phones, interactive video devices and conventional telephones, or remote devices, such as servers.

The system 100 also consists of sufficient computing and wireless communications capacity necessary to communicate with other local and remote device(s) to access information about the medication regimen and report adherence results. Software tools can be used to manage medications, and special processes can be used to ensure high quality in the filling and dispensing process. In a preferred embodiment, multiple prescription patients would be the most advantageous users of the medication adherence system. As the system 100 is loaded with prescription drugs, data about each prescription drug is loaded into the system 100 and is subsequently used to direct the filling of the compartments 32 of the storage tray 30 or direct the dispensing of the medication content of the compartments 32 of the storage tray 30.

Figure 20:
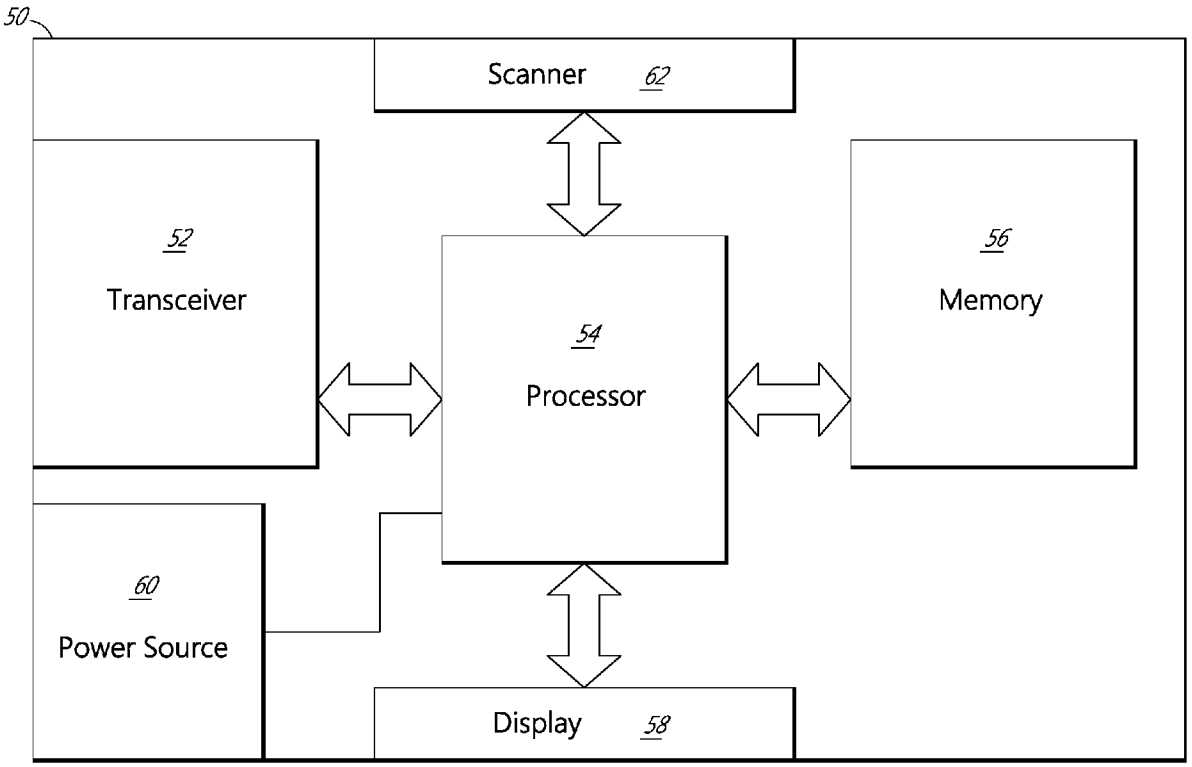
FIG. 20 is a block diagram of a communication system of the sorting and dispensing system of FIG. 1 in accordance with an embodiment of the invention.
Figure 2I:
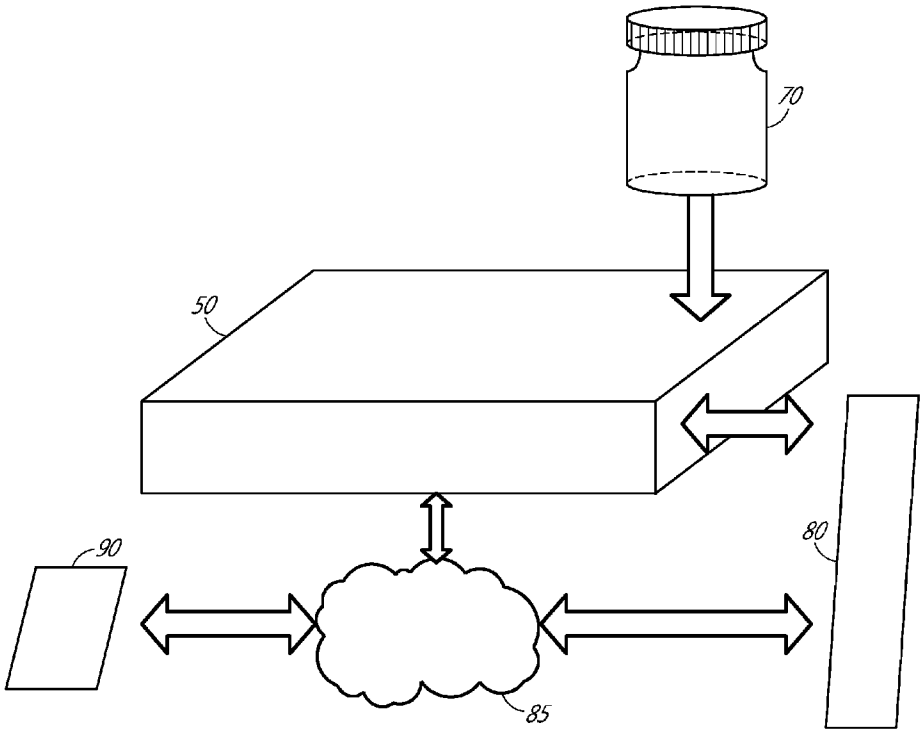

FIG. 20 is a block diagram of the communication and data processing system 50 of the system 100 of FIG. 1 in accordance with an embodiment of the invention. The communication and data processing system 50 comprises a transceiver 52 for wireless communications, connected to a processor 54, memory 56, display 58, and power source 60, such as a rechargeable cell, standard alkaline cell, or similar type cell. A scanning or communicating element 62 is also provided to scan or otherwise interpret a barcode, quick response code, identification number or RFID chip of the commercial package 70 when placed adjacent to the system 100 as illustrated in FIG. 21. The communication and data processing system 50 of the system 100 can be configured as shown in FIGS. 11 to 16. The system 50 can be fabricated using application-specific integrated circuits (ASIC), including entire microprocessors, memory blocks including ROM, RAM, EEPROM, and system on chip (SoC). The circuits of the system 50 can be arranged in any suitable manner as shown in the layouts of FIGS. 11 to 16, wherein the circuits can be disposed on any number of circuit boards 64 with wiring harnesses 66 between elements.

As noted above, the communication and data processing system 50 of the system 100 processes information received or detected from the commercial medication package 70. The system 100 can process the information with or without additional information obtained by still other communications with other local and remote devices, The other devices can be peripherals and devices in the user's ecosystem, including local devices 80, such as printers, wired or wireless telephone lines, blood pressure monitors, smart scales, smart phones, tablets, pagers, cell phones, interactive video devices and conventional telephones, or remote devices 90, such as a server.

As shown in FIG. 21, the communication and data processing system 50 of the system 100 can receive or detect data from the barcode, quick response code, identification number or RFID chip of a commercial medication package 70, and can communicate directly with the local other devices 80, printers, wired or wireless telephone lines, blood pressure monitors, smart scales, smart phones, tablets, pagers, cell phones, interactive video devices and conventional telephones, or indirectly, such as through a network 85 provided to communicate with remote other devices 90, such as the server, for bidirectional data exchange and communications regarding prescription and prescription regimen information, prescription content placement on the system 100, and user adherence to such prescription and prescription regimen information in response to the recognition of the commercial medication package 70. FIG. 21 is a network illustration of the exemplary communications of the system 100 of FIG. 1 in accordance with an embodiment of the invention.

The communications of the system 100 can be implemented using any of a wired or wireless communication link, LAN, WLAN, ISDN, X.25, DSL, and ATM type network or combination thereof for example, and others as specified under the IEEE 802 wireless standards, including but not limited to 802.11 (WiFi, WLAN), 802.15 (WPAN, Bluetooth, ZigBee), 802.16 (WMAN) and cellular. Connection to the local and remote devices 80 and 90, and the external data network 85 can include well-known methods such as RF, including 802.11 and Bluetooth standards, IRDA, various wireless data systems including pager networks, cellular packet data, and 2G and 3G systems, and physical serial connections such as the USB or Firewire standards, The processor 54 can comprise a typical combination of hardware and software including system memory, operating system, application programs, graphical user interface (GUI), processor, and storage. This can further include software to drive the feeder conveyor 10, the singulating module 20 and the dispensing module 40, and to drive the interaction with the user, and to communicate with other devices and data transmission units. Memory 56 can be provided as RAM, ROM, or similar memory, which can contain electronic information such as prescription and prescription regimen information, identification and location of compartments 32 on the system 100, and algorithms to calculate and identify compartments 32 in which to place a medication. Based upon the detected prescription and prescription regimen information obtained from any of the commercial package 70, adjacent other devices 80 and remote other devices 90, the communication and data processing system 50 of the system 100 can calculate and identify compartments 32 in which to place a medication, and drive the feeder conveyor 10, the singulating module 20 and the dispensing module 40 to place the medication in the identified compartments 32 of the storage tray 30 or direct the dispensing of the medication content of the compartments 32 of the storage tray 30.

Figure 18:
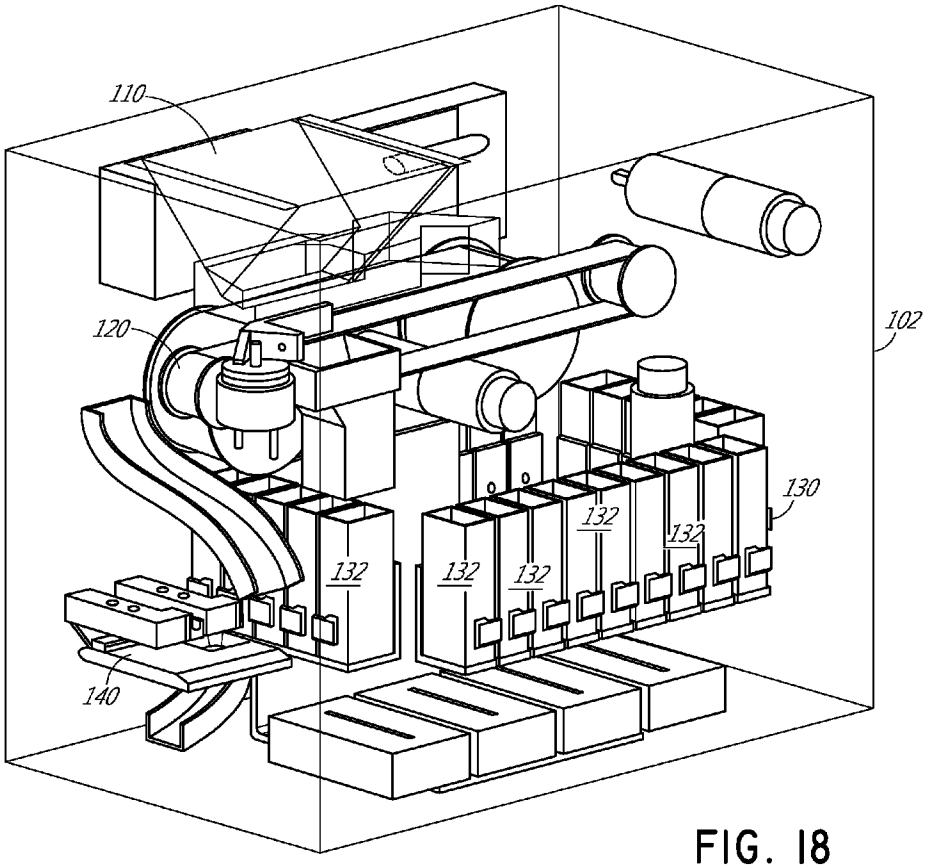
FIG. 18 is a perspective transparent view of an exemplary embodiment of the sorting and dispensing system of FIG. 1 in accordance with an embodiment of the invention.
Figure 19:
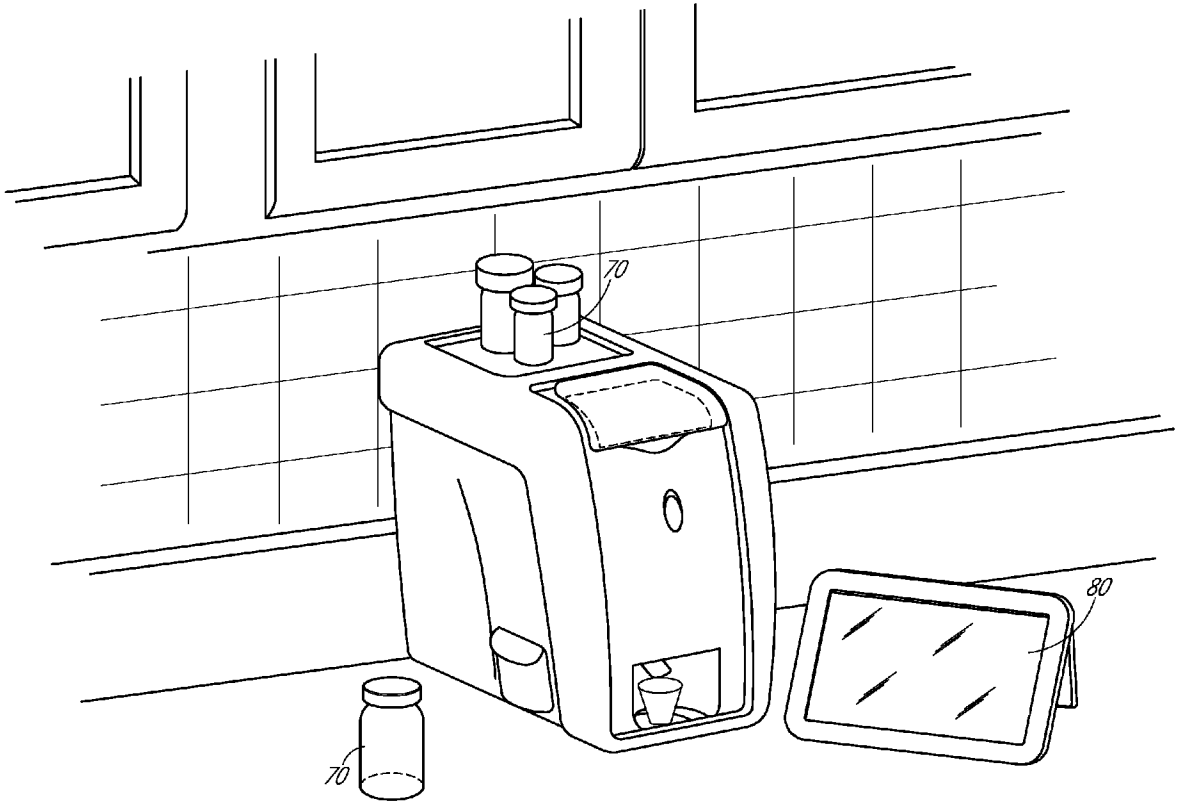
FIG. 19 is another perspective view of an exemplary embodiment of the sorting and dispensing system of FIG. 1 in accordance with an embodiment of the invention.

The embodiments of FIGS. 1 to 17 illustrate exposed components of the sorting and dispensing system 100. FIG. 18 is a perspective transparent view of an exemplary embodiment of the sorting and dispensing system of FIG. 1 in an assembled and enclosed condition. The sorting and dispensing system 200 is constructed as described above in regard to the system 100, but is contained within a body 102. As seen in the transparency, the exemplary system 200 includes a feeder module 110, a singulator module 120, a compartmentalized storing module 130, and a dispensing module 140. The feeder module 110 and singulator module 120 are configured to receive and deliver a medication content at a specific rate and quantity to the desired location of the desired storage module 130. To do so, the singulating module 120 receives the multitude of pills from the feeder module 110 and separates them into uniquely addressable single elements (pills) that are then placed (pushed, dropped, pulled, lifted) into a specific storage compartments 132 in the storage module 130. The singulating module 120 can also receive bulk medication directly from a medication container (e.g. bottle) and serve a single pill directly to the user, on-demand, all as directed by a medication regime. A housing can be provided for the device of FIG. 18 as shown in FIG. 19, wherein the device 100, 200 is free to operate while communicating with both the packaging 70, and the local device 80, to perform the functions described above.

Figure 22:
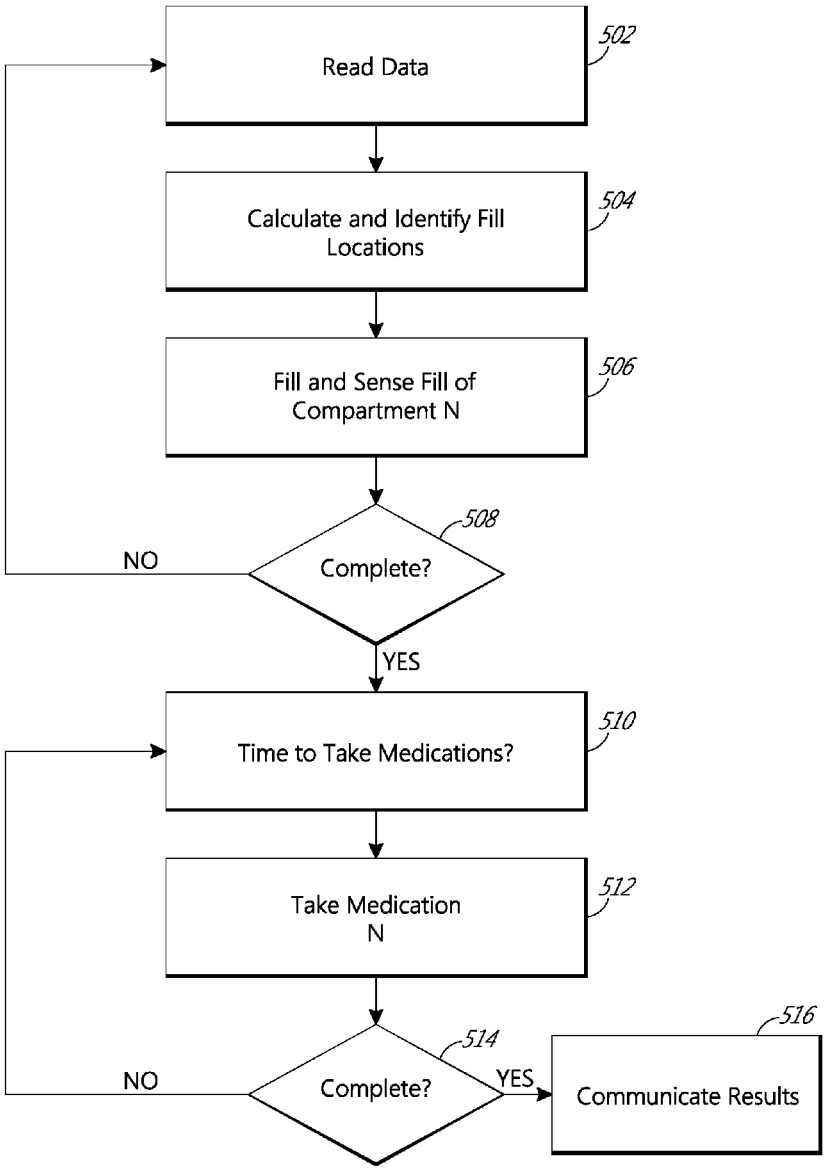
FIG. 22 illustrates a flow diagram of a method for utilizing the sorting and dispensing system of FIG. 1 in accordance with an embodiment of the invention.

FIG. 22 illustrates a flow diagram of a method for utilizing the system of FIG. 1 in accordance with an embodiment of the invention. In the method, a patient can simply open and present any number of pill bottles 70 to the system 100, and then allow the system 100 to arrange the medication in the chambers 32 of the storage tray 30 according to the known regimen. The regimen and regimen updates are communicated to the system by means of the wired or wireless transmission to the system 100 from a remote location (e.g. pharmacy or doctor's office), by direct user input, or by reading such information from a barcode or similar information carrier affixed to the pill bottles.

Specifically, upon presentation of a prescription, the system 100 reads identifying characteristics such as a barcode, RFID tag, quick response code or identification number or text of the commercial package 70 containing the prescription at step 502 to obtain prescription and regimen information. Prescription and regimen information that can be obtained by the system 100 includes data about which medication is contained in each commercial package or pill bottle 70 and the time and date the medication is to be taken, and based thereon, which specific compartment 32 on the storage tray 30 each medication occupies. The system 100 can further obtain information regarding how to take or dispense the medication, and other information commonly found on conventional medication labels, including the date dispensed. Still other prescription information that can be obtained by system 100 includes data which identifies who dispensed and/or prescribed the medications and the name of the facility and/or operator that provided the commercial package or pill bottle 70. Other information that may be useful when deciding which specific compartment 32 on the storage tray 30 each medication occupies can be received from the local devices 80, such as smart phones, tablets, pagers, cell phones, interactive video devices and conventional telephones, blood pressure monitors, smart scales, and other similar devices, or remote devices 90, such as a server. Additional prescription information can also be included for the storage tray 30 as a whole, including the identity of the individual patient, the range of dates for the medications included on the storage tray 30, expiration or "use by" dates, and an identification number unique to that storage tray 30 (e.g., a serial number).

Each compartment 32 on the storage tray 30 can contain a single medication or a plurality of different medications to be taken together at the same time, as prescribed by the healthcare service provider. The system 100 arranges and stores multiple pills in the specific combinations to be taken at specific times according the patient's prescriptions. The system 100 also checks the prescriptions to identify potential conflicts that could result in adverse interactions, and adapts to the user's specific preferences, for example, by using adaptive software that customizes a graphical user interface, the notifications type, and the connectivity to other devices.

As noted above, the method of FIG. 22 begins when the compartments 32 are to be filled with medicine. Prescription and regimen data is transferred in step 502 from the commercial packaging or pill bottle 70 to the system 100, via barcode, quick response code, identification number or RFID chip (including low-bit tags), or data port, where it is stored in memory. Other prescription or regimen information can be received from the local devices 80, such as smart phones, tablets, pagers, cell phones, interactive video devices and conventional telephones, blood pressure monitors, smart scales, or remote devices 90, such as a server. The action of filling causes prescription data to be automatically transferred and stored to the system 100.

Once the prescription and regimen data is stored in memory of the system 100, the processor ascertains the medication regime, either from the prescription data, or from communications received from the local or remote devices 80 and 90, and begins, at the appropriate times and in the appropriate manner, to automatically fill the medication compartments 32 as directed at step 504. For example, upon presentation of a prescription, the system 100 looks up the prescribed regimen and computes the set of locations or compartments 32 to which the medication should be stored for later dispensation.

The system 100 then identifies each subsequent commercial packaging or pill bottle 70 in the same manner, until all the contents of the commercial packaging or pill bottle have been transferred to the storage tray 30 at step 508. To do the singulating module receives the multitude of pills from the feeder module or conveyor and separates them into uniquely addressable single elements (pills) that are then placed (pushed, dropped, pulled, lifted) into a specific storage compartment in the storage tray. The singulating module can also receive bulk medication directly from a medication container (e.g. bottle) and serves a single pill directly to the user, on-demand, all as directed by a medication regime. By looking up the regimen, computing the location and directing the automatic filling of compartments 32 of the storage tray 30, one at a time, the system 100 lowers the burden of correct medication sorting, and accurate and timely filling for users and caregivers. In another preferred embodiment, the system consists of an on-demand disbursement architecture. Here, the pills or medication are only arranged in the specific dose at the time of administration without a need to pre-sort and store for multiple times in a day and multiple days.

When the prescribed time to take a medication arrives, the system 100 can alert the patient to take a medication using acoustical, tactile and visual means or through wireless communications via pagers or other wireless devices carried by the user at step 510. Patients can also see this and other important information on how to take the medications on the visual display of such devices and on a display of the system 100. The system 100 verifies that the proper medications are being taken at the proper times, and as much as possible, in the proper manner.

At some point, time interval, content level or as queried by the local and remote devices 80 and 90, the system 100 can communicate collected and processed data through the network 85 to the service center or server 90 at step 516. This information can include the time and identities of medications placed into the system 100. If necessary, the service center server can send modifying medication use data to the system 100, and change or maintain the medication regimen for the patient. New medication use information can be conveyed to the patient, in the various different methods already described. For example, healthcare providers can communicate therapy, monitoring and behavioral changes, including modified medication use data using the data network back to the user via the system 100, or other user devices 80 such as a smart phones, tablets, pagers, cell phones, interactive video devices and conventional telephones described above.

As noted above, there are services that pre-pack custom mixes of pills and send them to the user or the pharmacy, and there are a number of devices that use small trays or compartments which are self-programmed by patients to remind them to take medications at a specific time, such as pill boxes at epill.com. All require manual filling and, when patients either self-program or self-fill the device, errors can occur. These errors become more common as the complexity of the medication regimen increases. Since these devices do not assist the user with identifying the medication, do not record or monitor medication usage, and are not connectable to an outside service or information provider, they have limited positive effect on medication adherence. Specifically, there are no devices that indicate which compartment to fill and more specifically, there are no devices that indicate which compartment to fill and automatically fill the required compartments based upon medication regimen information. Embodiments of the present invention can fulfill many of these unmet needs, and represent a significant improvement in patient care.

Embodiments of the present invention can arrange and disburse medications in a complex polypharmacy regimen according to the individual doses of a multiple medication per day schedule, for several days. The system arranges and/or disburses multiple pills in the specific combinations to be taken at specific times according the patient's prescriptions. The system checks the prescriptions to identify potential conflicts that could result in adverse interactions, and adapts to the user's specific preferences, for example, by using adaptive software that customizes a graphical user interface, the notifications type, and the connectivity to other devices. The system is configured to alert the user of the upcoming time to take medications, disburses the specific dose associated with that time, and records the event. In at least one exemplary embodiment, the system and method monitors the patients adherence to the treatment regimen by transmitting data associated with the event of the pills being disbursed to the user, to be used for monitoring adherence to the treatment regimen, and caregivers, family, and friends can be notified if the user misses a dose. In at least one exemplary embodiment, the system and method is configured to interface with multiple peripherals and devices in the user's ecosystem such as barcode readers, RFID readers, printers, wired or wireless telephone lines, blood pressure monitors, smart scales, and other similar devices.

An advantage of embodiments of the present invention over prior art is the dramatic simplification of the medication filling process. In prior devices, the user or caregiver must manually compute the correct medication locations and then fill them carefully to avoid mistakes. When a user has many simultaneous prescriptions, this can be a difficult and error prone process.

Prior art devices also require careful attention to detail when filling the device. Embodiments of the present invention can significantly reduce this burden by removing the mental effort and attention level required to prepare a weeklong complex polypharmacy regimen. This effort is reduced to the smallest possible unit of work and doesn't require knowledge of the full regimen or planning on the part of the user or caregiver.

The present invention has been described with reference to certain exemplary embodiments thereof However, it will be readily apparent to those skilled in the art that it is possible to embody the invention in specific forms other than those of the exemplary embodiments described above. This can be done without departing from the spirit and scope of the invention. The exemplary embodiments are merely illustrative and should not be considered restrictive in any way.

What is claimed is:

1. A medication dispensing device, comprising:

an identification sensor configured to read a plurality of codes, each code associated with one of a plurality of medication packages, each medication package housing one of a plurality of different medications;

a feeder module configured to receive the plurality of different medications;

a singulating module configured to sort the plurality of different medications into discrete doses;

a dispensing module configured to dispense the discrete doses; and a processor configured to:

determine a medication associated with each medication package based on the code associated with each medication package;

receive or determine medication prescription information associated with each determined medication;

determine one or more doses and, for each dose, a time at which to be taken for each determined medication based on the medication prescription information;

determine a schedule for dispensing discrete doses of the determined medications based on, for each determined medication, the determined doses and, for each dose, the determined time at which to be taken; and activate the dispensing module to dispense the discrete doses of the medication at the determined time at which each dose is to be taken.

2. The medication dispensing device of claim 1, further comprising a storage module, the storage module having a plurality of storage compartments for receiving one or more of the discrete doses.

3. The medication dispensing device of claim 2, wherein the processor is further configured to determine, for each dose, a selection of one of the storage compartments of the storage module for receiving the dose.

4. The medication dispensing device of claim 3, wherein the dispensing module is further configured to adjust the storage module to one or more positions at which to receive one or more of the discrete doses based on, for each dose, the determined selection of one of the storage compartments of the storage module for receiving the dose.

5. The medication dispensing device of claim 1, wherein the singulating module is configured to, for each dose, sort at least a portion of the plurality of medications into the dose at the determined time at which to be taken.

6. The medication dispensing device of claim 1, wherein the processor is further configured to identify adverse interactions that may result from two or more of the plurality of medications based on the medication prescription information.

7. The medication dispensing device of claim 1, further comprising a communication interface in wireless communication with one or more external devices.

8. The medication dispensing device of claim 7, wherein the communication interface is configured to transmit and receive data comprising one or more of: medication prescription information, schedule information, and user adherence information.

9. The medication dispensing device of claim 7, further comprising a storage module, wherein the communication interface is configured to transmit and receive dose location information.

10. The medication dispensing device of claim 1, further comprising a user interface configured to receive medication prescription information and schedule information input by a user, the user interface comprising a visual display configured to display medication prescription information and schedule information.

11. The medication dispensing device of claim 1, further comprising one or more indicators configured to indicate, for each dose, the determined time at which to be taken.

12. An electronic method for dispensing medication, comprising:

determining a medication associated with each of a plurality of medication packages using an identification sensor, each medication package housing one of a plurality of different medications;

determining or receiving by a processor medication prescription information associated with each determined medication;

receiving a plurality of determined medications at a feeder module;

determining by the processor one or more discrete doses and, for each dose, a time at which to be taken for each determined medication based on the medication prescription information;

determining by the processor a schedule for dispensing discrete doses of the determined medications based on, for each determined medication, the determined doses and, for each dose, the determined time at which to be taken;

sorting the plurality of determined medications into discrete doses based on the determined schedule; and dispensing each dose at the determined time at which each dose is to be taken.

13. The method of claim 12, further comprising determining by the processor, for each dose, a location in a storage container.

14. The method of claim 13, further comprising transmitting dose location information to one or more external devices.

15. The method of claim 12, further comprising identifying adverse interactions that may result from two or more of the plurality of medications based on the medication prescription information.

16. The method of claim 12, further comprising transmitting an alert, for each dose, at the determined time at which to be taken.

17. The method of claim 12, further comprising monitoring schedule adherence.

18. The method of claim 12, further comprising transmitting to one or more external devices one or more of: medication prescription information, schedule information, and user adherence information.

19. The method of claim 12, wherein receiving medication prescription information comprises detecting medication prescription information using the identification sensor, an external device or via a user interface.

20. The method of claim 12, wherein sorting the plurality of determined medications into discrete doses based on the determined schedule comprises sorting at least a portion of the plurality of medications into the discrete doses at the determined time at which to be taken.

21. An electronic medication dispensing device, comprising:

an identification sensor configured to read a plurality of codes, each code associated with one of a plurality of medication packages, each medication package housing one of a plurality of different bulk medications;

a communication module configured to receive medication prescription information;

a singulating module configured to receive the plurality of different bulk medications, the singulating module further configured to sort the plurality of different bulk medications into discrete doses;

a dispensing module configured to dispense the discrete doses; and a processor configured to:

determine a bulk medication associated with each medication package based on the code associated with each medication package;

determine medication prescription information associated with each determined bulk medication from the received medication prescription information;

determine one or more doses and, for each dose, a time at which to be taken for each determined medication based on the medication prescription information;

determine a schedule for dispensing discrete doses of the determined bulk medications based on, for each determined medication, the determined doses and, for each dose, the determined time at which to be taken; and activate the dispensing module to dispense the discrete doses at the determined time at which each dose is to be taken.

22. The medication dispensing device of claim 21, further comprising a storage module, the storage module having a plurality of storage locations for receiving one or more of the discrete doses, wherein the processor is further configured to determine, for each dose, one of the storage locations of the storage module.

23. The medication dispensing device of claim 22, wherein the dispensing module is configured to dispense the discrete doses into the storage location for each dose.

24. The medication dispensing device of claim 22, wherein the dispensing module is further configured to adjust the storage module to one or more positions at which to receive one or more of the discrete doses based on, for each dose, the determined selection of one of the storage compartments of the storage module for receiving the dose.

25. The medication dispensing device of claim 21, wherein the singulating module is configured to, for each dose, sort at least a portion of the plurality of medications into the dose at the determined time at which to be taken.

* * * * *